US011127369B2

(12) United States Patent
Liu et al.

(10) Patent No.: US 11,127,369 B2
(45) Date of Patent: Sep. 21, 2021

(54) METHOD OF SYNTHESIZING RGBA LAYERS FOR MOBILE FIELD SEQUENTIAL DISPLAY, DISPLAY DEVICE, ELECTRONIC DEVICE AND COMPUTER READABLE STORAGE MEDIUM USING THE SAME

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Wenhao Liu, Beijing (CN); Xiurong Wang, Beijing (CN); Yuting Zhang, Beijing (CN); Xin Duan, Beijing (CN); Lingyun Shi, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 56 days.

(21) Appl. No.: 16/542,092

(22) Filed: Aug. 15, 2019

(65) Prior Publication Data

US 2020/0286446 A1 Sep. 10, 2020

(30) Foreign Application Priority Data

Mar. 4, 2019 (CN) ..... 201910160806.X

(51) Int. Cl.
*G09G 5/02* (2006.01)

(52) U.S. Cl.
CPC ..... *G09G 5/026* (2013.01); *G09G 2310/0235* (2013.01); *G09G 2320/0666* (2013.01);
(Continued)

(58) Field of Classification Search
CPC ..... G09G 2310/0235; G09G 5/026; G09G 3/3413; G09G 2340/10
See application file for complete search history.

(56) References Cited

U.S. PATENT DOCUMENTS 7,825,921 B2 * 11/2010 Han ..... G09G 5/006 345/213
2002/0122019 A1 * 9/2002 Baba ..... G09G 3/3607 345/88

(Continued)

OTHER PUBLICATIONS

Hsu et al., A Field Sequential Color LCD Base on Color Field Arrangement for Color Breakup and Flicker Reduction, IDW 2007 (Year: 2007).*

(Continued)

*Primary Examiner* — Phuc N Doan
(74) *Attorney, Agent, or Firm* — Kinney & Lange, P.A.

(57) ABSTRACT

Embodiments of the disclosure provide a display method, a display device, an electronic device and a computer readable storage medium. A plurality of second image data groups are obtained by performing color separation and sorting on the first image data of each layer pixel according to color information. Each of the second image data groups is synthesized, so as to obtain a plurality of synthesized layer data for the plurality of colors, and the plurality of synthesized layer data are sequentially displayed in the preset order of the colors.

14 Claims, 7 Drawing Sheets

(52) U.S. Cl.
CPC ... *G09G 2340/10* (2013.01); *G09G 2360/121* (2013.01); *G09G 2360/18* (2013.01)

(56) References Cited

U.S. PATENT DOCUMENTS

| | | | | |
|---|---|---|---|---|
| 2010/0079489 | A1* | 4/2010 | Cheng | G11B 27/034 345/629 |
| 2011/0221741 | A1* | 9/2011 | Kawamura | H05B 33/10 345/214 |
| 2016/0225343 | A1* | 8/2016 | Ek | H04N 13/334 |
| 2020/0029057 | A1* | 1/2020 | Holmes | H04N 9/3111 |

OTHER PUBLICATIONS

Sun, RGBW color separation for field sequential color LCDs, Proc. SPIE 6807, Color Imaging XIII: Processing, Hardcopy, and Applications, 68070B (Jan. 28, 2008); doi: 10.1117/12.767135 (Year: 2008).*

Bolas, OpenGL Separating RGB channels—Stack Overflow, URL: https://stackoverflow.com/questions/15209630/opengl-separating-rgb-channels (Year: 2013).*

Display Separated Color Channels of RGB Image—MATLAB & Simulink, URL: https://www.mathworks.com/help/images/display-separated-color-channels-of-rgb-image.html (Year: 2018).*

* cited by examiner

METHOD OF SYNTHESIZING RGBA LAYERS FOR MOBILE FIELD SEQUENTIAL DISPLAY, DISPLAY DEVICE, ELECTRONIC DEVICE AND COMPUTER READABLE STORAGE MEDIUM USING THE SAME

CROSS-REFERENCE TO RELATED APPLICATION(S)

This application claims the priority of Chinese Patent Application No. 201910160806.X filed on Mar. 4, 2019, the entire contents of which are hereby incorporated by reference.

TECHNICAL FIELD

Embodiments of the present disclosure relates to a field of display, and in particular to a method of displaying an image, a display device, an electronic device and a computer readable storage medium.

BACKGROUND

Field sequential displaying is to display RGB components of the frame picture on a screen sequentially, and synthesize the RGB components to a complete frame picture by using the visual inertia of human eyes, so as to maintain the visual perception. Therefore, a field sequential display device does not need a color film for filtering, but switches R, G and B backlights in synchronization with the RGB components.

SUMMARY

Embodiments of the present disclosure provide a display method, a display device, an electronic device and a computer readable storage medium.

According to an aspect of embodiments of the disclosure, there is provide a method of displaying by a display device, comprising:

acquiring an image to be displayed, the image comprising a plurality of layers;

acquiring a first image data of pixels in each of the plurality of layers, wherein the first image data comprises a plurality of color information and transparency information;

separating the first image data based on the plurality of color information, so as to obtain a plurality of second image data of the pixels in each of the plurality of layers, wherein each of the plurality of second image data comprises one color information and a transparency information;

sorting the second image data having the same color information among the plurality of second image data into one group, so as to obtain a plurality of second image data groups according to colors;

synthesizing the second image data in the plurality of second image data groups respectively, so as to obtain a plurality of synthesized layer data; and displaying the plurality of synthesized layer data sequentially in a preset order of the colors.

For example, the display device comprises a first buffer and a second buffer; and wherein acquiring the first image data of pixels in each of the plurality of layers comprises:

performing, by the first buffer, a receiving function, wherein the receiving function comprises receiving the first image data of pixels in each layer of a current frame;

performing, by the second buffer, a calling function, wherein the calling function comprises calling the first image data of a previous frame so as to separate the first image data of the previous frame based on the plurality of color information, and the first image data of the previous frame has been stored in a corresponding buffer before being called; and enabling the first buffer to perform the calling function and the second buffer to perform the receiving function, in response to the first buffer receiving the first image data of pixels in the each layer of the current frame and the separating of the first image data of the previous frame in the second buffer being completed.

For another example, separating the first image data based on the plurality of color information, so as to obtain the plurality of second image data of the pixels in each of the plurality of layers comprises:

obtaining texture information of each layer; and sampling the texture information of each layer, so as to obtain the plurality of second image data of the pixels in each layer.

For another example, synthesizing the second image data in the plurality of second image data groups respectively so as to obtain the plurality of synthesized layer data comprises:

arranging the plurality of second image data groups in a preset order, so as to generate a queue; and reading and synthesizing the second image data in the plurality of second image data groups in the queue sequentially, so as to obtain the plurality of synthesized layer data.

For another example, synthesizing the plurality of second image data groups respectively so as to obtain the plurality of synthesized layer data comprises:

synthesizing the second image data in each of the plurality of second image data groups respectively by using a Mobile Display Processor (MDP) or a Graphics Processing Unit (GPU), so as to obtain a plurality of synthesized layer data.

For another example, each of the plurality of layers is arranged in a stack, and wherein synthesizing the second image data in the plurality of second image data groups respectively so as to obtain a plurality of synthesized layer data comprises:

synthesizing the color information in the plurality of second image data groups according to the transparency information and an ordering of each layer in an overlapping direction, so as to obtain the plurality of synthesized layer data.

For another example, displaying the plurality of synthesized layer data sequentially comprises:

parsing and outputting the plurality of synthesized layer data sequentially in the preset order of the colors for displaying.

According to another aspect of the embodiments of the disclosure, there is provided a display device, comprising:

an acquiring module, configured to acquire an image to be displayed, the image comprising a plurality of layers and acquire a first image data of pixels in each of the plurality of layers, wherein the first image data comprises a plurality of color information and transparency information;

a separating module, configured to separate the first image data based on the plurality of color information, so as to obtain a plurality of second image data of the pixels in each of the plurality of layers, wherein each of the plurality of second image data comprises one color information and a transparency information;

a sorting module, configured to sort the second image data having the same color information among the plurality of second image data into one group, so as to obtain a plurality of second image data groups according to colors;

a synthesizing module, configured to synthesize the second image data in the plurality of second image data groups respectively, so as to obtain a plurality of synthesized layer data; and a displaying module, configured to display the plurality of synthesized layer data sequentially in a preset order of the colors.

According to yet another aspect of the embodiments of the disclosure, there is provided display device, comprising:

one or more processors; and a memory, configured to store one or more programs, wherein the one or more processors are configured to execute the one or more programs, so as to implement the method in accordance with any of the above embodiments.

For example, the display device further comprises a first buffer and a second buffer, and wherein the one or more processors are further configured to:

enable the first buffer to perform a receiving function, wherein the receiving function comprises receiving the first image data of pixels in each layer of a current frame;

enable the second buffer to perform a calling function, wherein the calling function comprises calling the first image data of a previous frame so as to separate the first image data of the previous frame based on the plurality of color information, and the first image data of the previous frame has been stored in a corresponding buffer before being called; and enable the first buffer to perform the calling function and the second buffer to perform the receiving function, in response to the first buffer receiving the first image data of pixels in the each layer of the current frame and the separating of the first image data of the previous frame in the second buffer being completed.

For another example, the one or more processors are further configured to:

obtain texture information of each layer; and sample the texture information of each layer, so as to obtain the plurality of second image data of the pixels in each layer.

For another example, the one or more processors are further configured to:

arrange the plurality of second image data groups in a preset order, so as to generate a queue; and read and synthesize the second image data in the plurality of second image data groups in the queue sequentially, so as to obtain the plurality of synthesized layer data.

For another example, the one or more processors are further configured to:

synthesize a plurality of second image data groups respectively by using a Mobile Display Processor (MDP) or a Graphics Processing Unit (GPU), so as to obtain a plurality of synthesized layer data.

For another example, the one or more processors are further configured to:

synthesize the color information of the second image data in each of the plurality of second image data groups according to the transparency information and an ordering of each layer in an overlapping direction, so as to obtain the plurality of synthesized layer data.

For another example, the display device further comprises:

a driving IC, configured to parse and output the plurality of synthesized layer data sequentially in the preset order of the colors, so as to be displayed by the display device.

According to still another aspect of the embodiments of the disclosure, there is provided an electronic device comprising the display device in accordance with any of the above embodiments.

According to another aspect of the embodiments of the disclosure, there is provided a computer readable storage medium having computer programs stored thereon which, when executed by a processor, implement the method in accordance with any of the above embodiments.

BRIEF DESCRIPTION OF THE DRAWINGS

In order to illustrate the technical solutions of the embodiments of the present disclosure more clearly, drawings used in the description of the embodiments will be briefly described below. Obviously, the drawings in the following description are only some of the embodiments of the present disclosure, and those skilled in the art can obtain other drawings according to these drawings with no effort.

DETAILED DESCRIPTION

In order to enable a better understanding of the technical objectives, features and advantages of the present disclosure, the embodiments of the present disclosure will be further described in detail below with reference to the drawings and specific implementations.

In a display panel, color display can be realized by setting sub-pixels and color films. The color film may block about 70% of a backlight, thereby leading to a low transmittance. The low transmittance may cause an increasing power consumption for a display panel. The field sequential display is to use RGB backlights, and may realize the color display by lighting the R, G and B backlights periodically, without setting sub-pixels and color films.

In order to realize the field sequence display, it is necessary to receive the R, G, and B component image data sent from a main board of an electronic device sequentially during one frame period, and switch illumination units disposed on the rear of the electronic device synchronously, so as to illuminate in the order of the three component data. If a frame image cannot be separated based on colors, the field sequence display cannot be used by an electronic device such as a mobile terminal.

Figure 1:
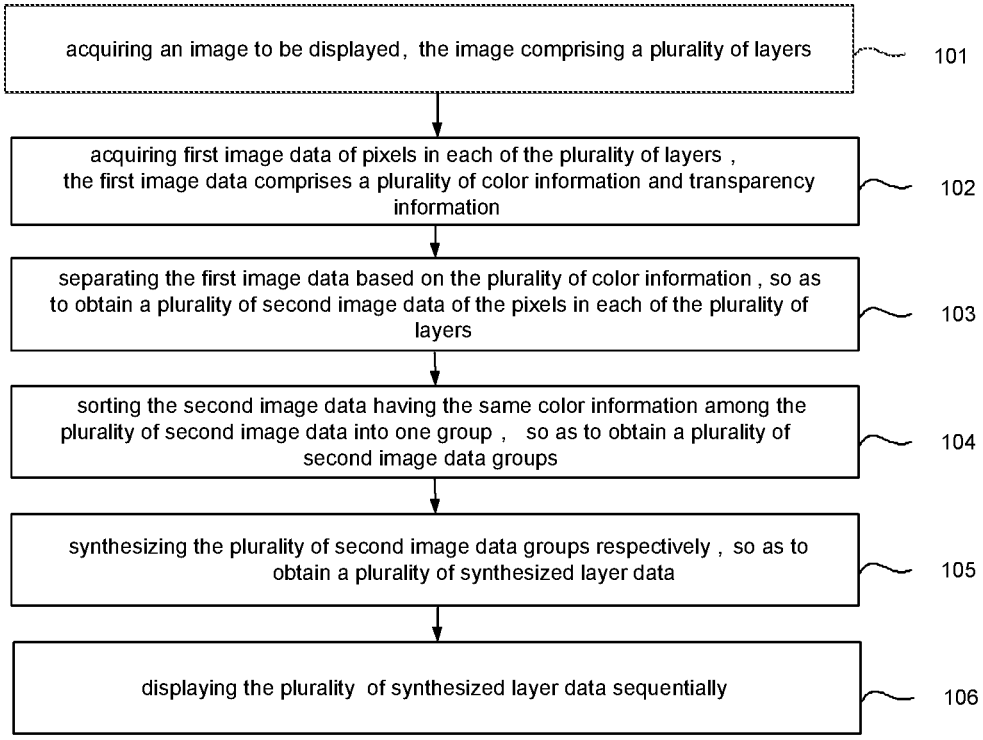
FIG. 1 shows a flow chart of a display method according to an embodiment of the present disclosure.

The embodiments of the present disclosure provide a display method, which can be applied to a display device. Referring to FIG. 1, the method may include the following steps.

At step 101, an image to be displayed is acquired. For example, the image may comprise a plurality of layers.

Figure 2:
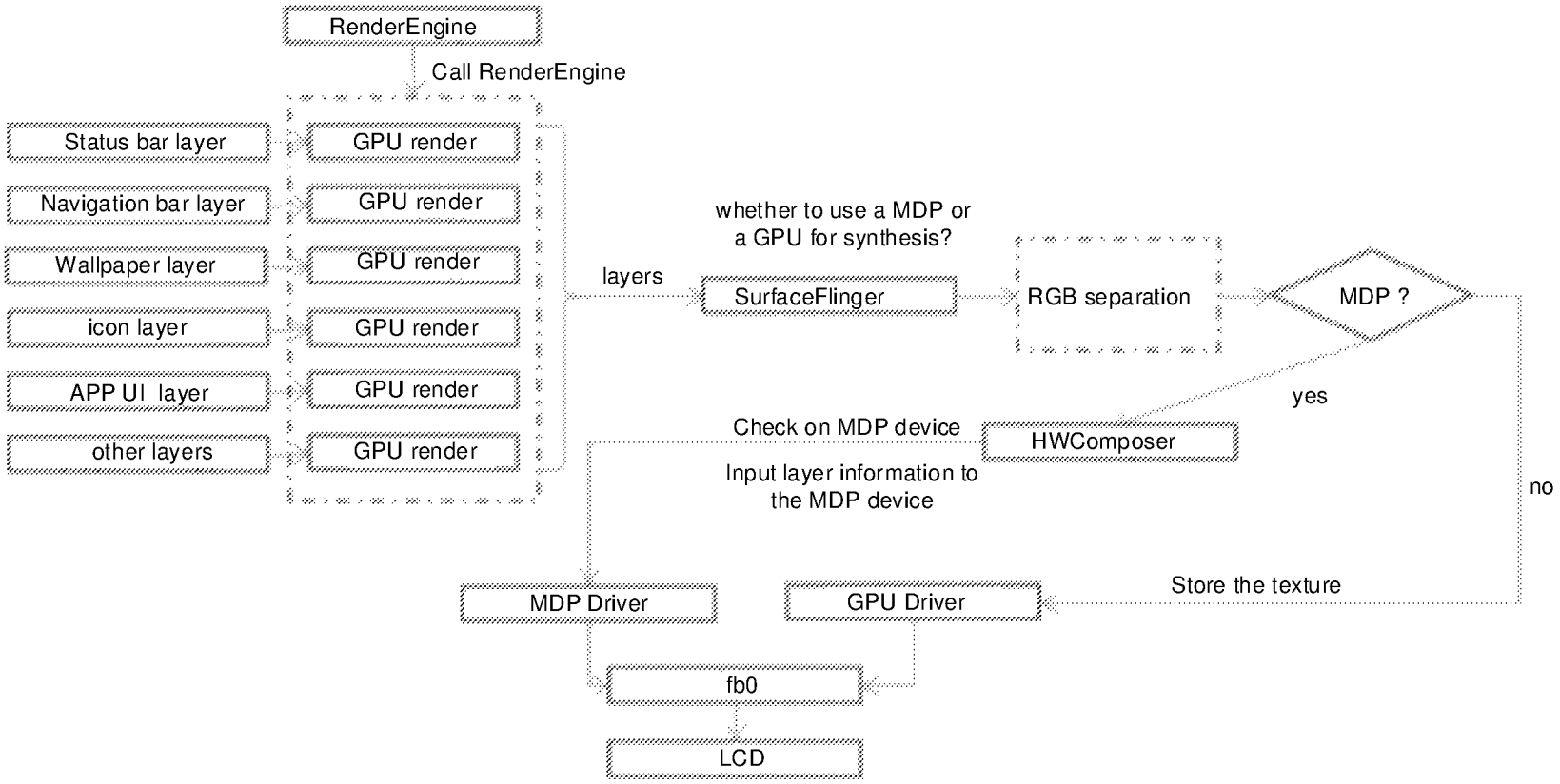
FIG. 2 shows a flow schematic diagram illustrating the display method according to an embodiment of the present disclosure.

In practical applications, each of the plurality of layers can be drawn by an operating system (such as, Android, IOS, etc.) of the electronic device. Referring to FIG. 2, the plurality of layers may include a status bar and a navigation bar. If the current interface is a desktop, the plurality of layers may further comprise a wallpaper layer and an icon layer. If the current interface is an APP interface, the plurality of layers may further comprise respective View layers included in the APP.

At step 102, a first image data of pixels in each of the plurality of layers is acquired. The first image data may comprise a plurality of color information and transparency information.

For example, the plurality of layers may be generated and rendered separately, so as to obtain the first image data of the pixels in each layer.

For example, each of the plurality of layers can call the RenderEngine class of the system framework layer, and each of the plurality of layers is GPU rendered and stored in the respective buffers, thereby obtaining the first image data of the pixels in each layer (cache data of each layer). Then, the first image data of the pixels in each layer is submitted to SurfaceFlinger.

In one example, the first image data may include RGBA data of the pixels in each layer, where R is a first color information, G is a second color information, B is a third color information, and A is a transparency information.

Those skilled in the art should understand that the plurality of colors are not limited to the above three colors, i.e. R, G, B, and in the actual application, it may be two colors, four colors, and the like, which is not limited in this embodiment. This embodiment is described by taking a plurality of colors being three colors of RGB as an example.

At step 103, the first image data is separated based on the plurality of color information, so as to obtain a plurality of second image data of the pixels in each of the plurality of layers. For example, each of the plurality of second image data comprises one color information and a transparency information.

The number of the second image data can correspond to the numbers of the color information, i.e. the plurality of the second image data can include the second image data corresponding to the numbers of the colors.

There are various implementations of separating first image data of pixels in each layer based on colors.

In one implementation, RGBA data of pixels in each layer acquired at step 102 can be RGB separated by a central processing unit CPU directly, so as to obtain a plurality of second image data of pixels in each layer corresponding to each color. For example, the second image data RA of a first color, the second image data GA of a second color, and the second image data BA of the third color are obtained.

Figure 3A:
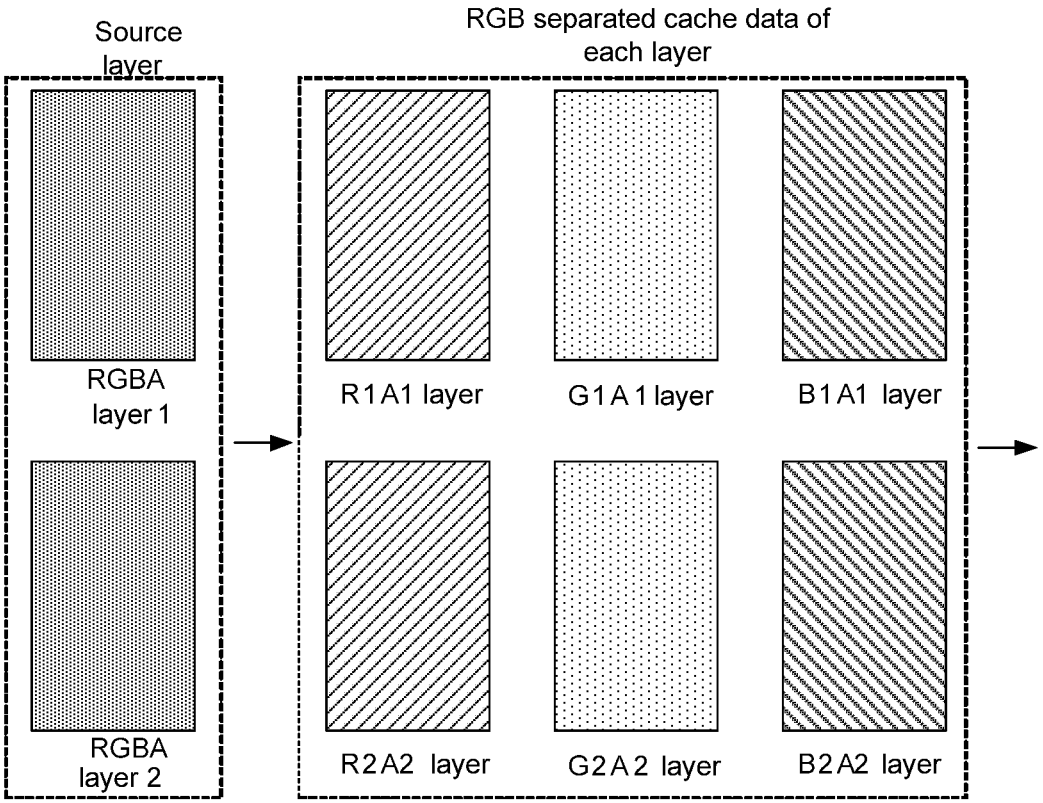
FIG. 3A to 3C show schematic diagrams illustrating steps of performing RGB separation, sorting and synthesizing on two layers according to an embodiment of the present disclosure, respectively.
Figure 3B:
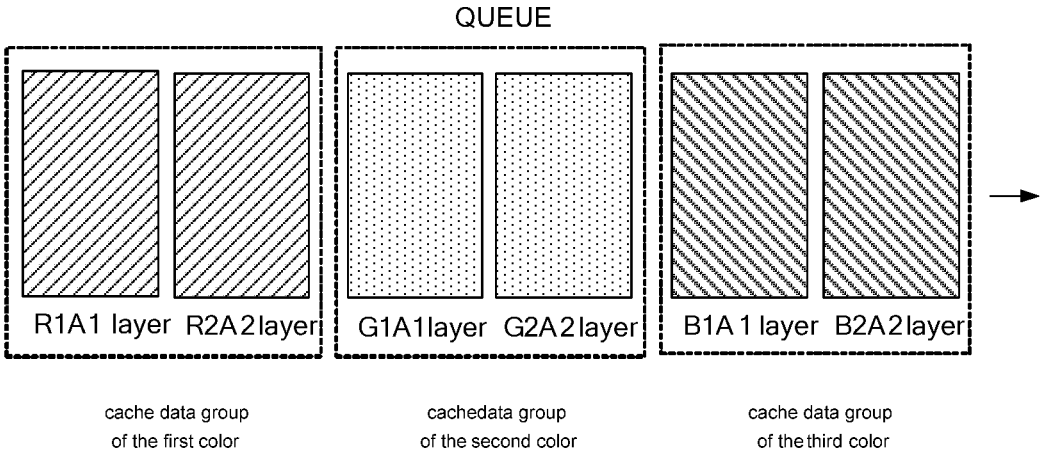
Figure 3C:
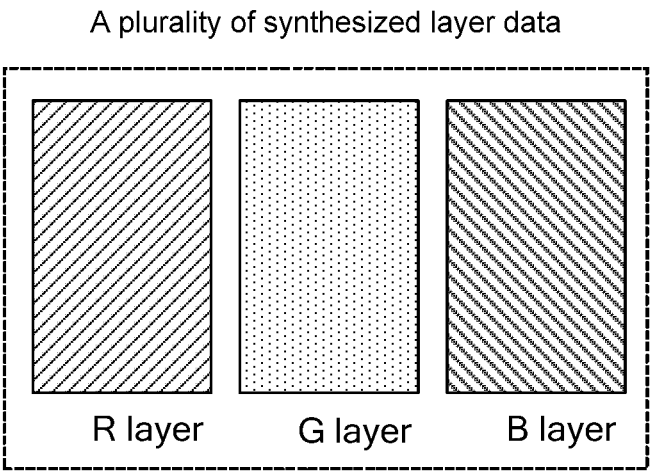

In another implementation, the texture of the first image data of pixels in each layer can be rendered by a graphics processor GPU for a plurality of times, so as to achieve a RGB color separation for cache data of each layer. The cache data of each layer can be separated to obtain a plurality of second image data for the plurality of colors. As shown in FIG. 3A to FIG. 3C, the second image data RA of the first color, the second image data GA of the second color, and the second image data BA of the third color are obtained. This implementation may have a high separation efficiency, and will be described in detail in the following embodiments.

Next, at step 104, the second image data having the same color information among the plurality of second image data is sort into one group, so as to obtain a plurality of second image data groups.

The number of the groups of the second image data may equal to the number of colors, and the plurality of second image data groups may include a plurality of second image data groups corresponding to the plurality of colors. The number of elements in each group of the second image data may be the same as the number of layers.

For example, the second image data obtained after the separation may be sorted based on colors, so as to sort the second image data of the pixels in each layer having the same color into one group, so as to obtain a plurality of second image data groups for the plurality of colors. For example, the second image data group {R1A1, R2A2, . . . , RnAn} of the first color, the second image data group {G1A1, G2A2, . . . , GnAn} of the second color and the second image data group {B1A1, B2A2, . . . , BnAn} of the third color are obtained, wherein n represents the number of layers. FIGS. 3A to 3C show schematic diagrams of steps of performing RGB separation, sorting and synthesizing on two layers, respectively.

The second image data group includes transparency information and color information of a certain color of pixels in each layer.

At step 105, the second image data in the plurality groups of second image data are synthesized respectively, so as to obtain a plurality of synthesized layer data.

Among others, the number of the synthesized layer data may be the same as the number of the plurality of colors, and the plurality of synthesized layer data may include synthesized layer data corresponding to respective colors.

For example, the synthesizing method may be determined by SurfaceFlinger, and the plurality of second image data groups may be synthesized separately, so as to obtain a plurality of synthesized layer data and transmit the synthesized layer data to a driving IC. For example, a code may be inserted in the surfaceflinger, such that the layer buffer data groups of the first color {R1A1, R2A2, . . . , RnAn} are synthesized by the MDP/GPU to obtain the synthesized layer data of the first color, i.e. R layer; the layer buffer data groups of the second color {G1A1, G2A2, . . . , GnAn} are synthesized by the MDP/GPU to obtain the synthesized layer data of the second color, i.e. G layer; the layer buffer data groups of the third color {B1A1, B2A2, . . . , BnAn} are synthesized by the MDP/GPU to obtain the synthesized layer data of the third color, i.e. B layer, with reference to FIGS. 3A to 3C.

Referring to FIG. 2, Surfaceflinger can determine whether to use MDP (Hardware Layer Synthesizer) or GPU to perform synthesis according to the current usage scenario or not. For example, for scenes with high requirements on synthesis efficiency, such as video applications, MDP can be used for synthesis. For scenes with low refresh frequency requirements, such as e-books, GPUs with lower synthesis efficiency can be selected for synthesis, which can reduce the power consumption.

Next, at step 106, the plurality of synthesized layer data is sequentially displayed in the preset order of the colors.

In an example implementation, the plurality of synthesized layer data is parsed and outputted by the driving IC sequentially for displaying.

For example, when a plurality of colors are three colors of RGB, three synthesized layer data may be transmitted to the driving IC at a frequency being a triple of the frame rate (for three colors, for example). The driving IC sequentially parses and outputs the synthesized layer data of the first color, the synthesized layer data of the second color, and the synthesized layer data of the third color. At the same time, a first color backlight, a second color backlight, and a third color backlight are sequentially switched and illuminated in synchronization, thereby realizing the field sequential display.

In the example, the driving IC of a field sequential display screen can transmit a VYSYNC signal (signal with a frequency being a triple of the frame rate). The HAL layer acquires the VSYNC signal and then delivers the signal to a VSYNC daemon. The VSYNC daemon adds the VSYNC signal to the MessageQueue of the SurfaceFlinger by a message. Finally, the SurfaceFlinger obtain the VSYNC signal and trigger the upper synchronization logic. That is, the SurfaceFlinger performs Step 103, Step 104 and Step 105 under the driving of the VYSYNC signal, and sends it to the driving IC. The field sequential display screen performs the field sequential display under a driving of the synchronization signal VSYNC.

According to the display method of the present embodiment, by performing a color based separation and sorting on the first image data of pixels in each layer, the plurality of second image data groups are obtained. Each second image data group is separately synthesized, such that the plurality of synthesized layer data for a plurality of colors is obtained. The plurality of synthesized layer data are displayed sequentially, thereby realizing field sequential display on the electronic device, reducing cost and the power consumption, and improving the life time of the electronic device. Further, since the field sequence display does not need to set subpixels, the aperture ratio can be increased by 33% theoretically, and a higher PPI can be achieved based on the existing process, achieving a better display effect.

Figure 4:
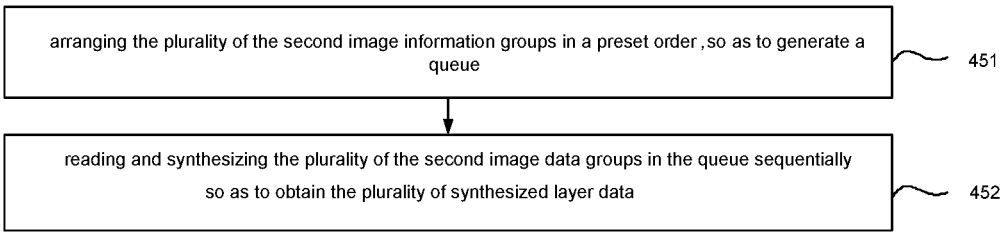
FIG. 4 shows a flow schematic diagram illustrating a method for synthesizing according to an embodiment of the present disclosure.

In an example implementation, referring to FIG. 4, the above step 105 may further include the following steps.

At step 451, the plurality of the second image data groups is arranged in a preset order, so as to generate a queue.

The preset order may be a preset order for the plurality of colors, and may be an arbitrary arrangement order among the first color R, the second color G, and the third color B. For example, the plurality of second image data groups with different colors may be queued in RGB order, as shown in FIGS. 3A-3C.

At step 452, the plurality of the second image data groups in the queue are read and synthesized sequentially, so as to obtain the plurality of synthesized layer data. For example, the plurality of synthesized layer data are arranged in the preset order so as to form a synthesized layer queue.

In the example, n source layers (RGBA layers) can be separated and sorted. Then, in accordance with the order of RGB, the queue consisting of n RA layer buffers (cache data group of the first color of respective layers), n GA layer buffers (cache data group of the second color of respective layers), and n BA layer buffers (cache data group of the third color of respective layers) is generated and then sent to the MDP or GPU. The MDP or GPU sequentially reads the second image data group of each color in the queue and performs synthesis, so as to obtain the plurality of synthesized layer data (such as R layer, G layer, and B layer) corresponding to colors. The plurality of synthesized layer data may be arranged in a synthesized layer queue according to a preset order of colors (such as RGB). For example, a synthesized layer queue is generated in the order of R layer, G layer, and B layer, and then sent to the driving IC, so as to be displayed by the filed sequential display screen.

In an example implementation, the step 105 may further include: synthesizing the second image data in the plurality of second image data groups by using an MDP or a GPU, so as to obtain a plurality of synthesized layer data.

For example, if the synthesis is performed by using MDP, Surfaceflinger sends cache data group having the same color (such as R) of each layer (such as the second image data group of the first color {R1A1, R2A2, . . . , RnAn}) to HWComposer (hardware composing interface). HWComposer will check the MDP device, send cache data group of each layer to the MDP for synthesis in response to an acknowledgement. The MDP outputs the synthesized layer data (such as R layer) to the driving IC.

If the GPU is used to perform the composition, then cache data group having the same color of each layer (such as the second image data group of the first color {R1A1, R2A2, . . . , RnAn}) is mixed in the Surfaceflinger. Then, the OpenGLes texture is called. Cache data group having the same color of each layer is transmitted to the GPU texture at one time, and rendered by the GPU texture, so as to obtain the synthesized layer data and output it to the driving IC.

Among them, HWComposer is an interface class, which is a standard designed to be compatible with various types of MDP hardware. Opengles is also a graphical interface designed to be compatible with a wide range of GPUs.

In an example implementation, the step 105 may include: synthesizing the color information in the plurality of the second image data groups according to the transparency information in the plurality of the second image data groups and an ordering of each layer in an overlapping direction, so as to obtain the plurality of synthesized layer data.

The overlapping direction may be a light emitting direction of the display panel. For example, this direction can be referred to as the "z" direction.

For example, the order of n layers in the z direction is 1, 2, . . . n. The second image data group of the first color of the n layers is {R1A1, R2A2, . . . , RnAn}. Synthesizing the second image data group of the first color may comprise: synthesizing the color information in the plurality of the second image data groups according to the transparency information in the second image data group of the first color and an ordering of n layers in the z direction, so as to obtain the synthesized layer data for the first color.

For example, firstly, the first and second layers are synthesized, obtaining $X2=R2*A2+R1*(1-A2)$; then, the first, second, and third layers are synthesized to obtain $X3=R3*A3+X2*(1-A3)$, . . . , and finally, the n layers are synthesized to obtain the synthesized layer data of the first color, i.e., R layer$=Xn=Rn*An+Xn-1*(1-An)$. A similar calculation method can be used to obtain the synthesized layer data of the second color G layer and the synthesized layer data of the third color B layer.

In addition, in order to realize the field sequential display, the obtained image data (synthesized layer data) of three colors R, G, and B needs to be output to the driving IC at a speed being a triple of the frame rate. The electronic device is influenced by the upper layer drawing rate and may not be able to output R, G, and B component data at a triple of the frame rate.

Figure 5:
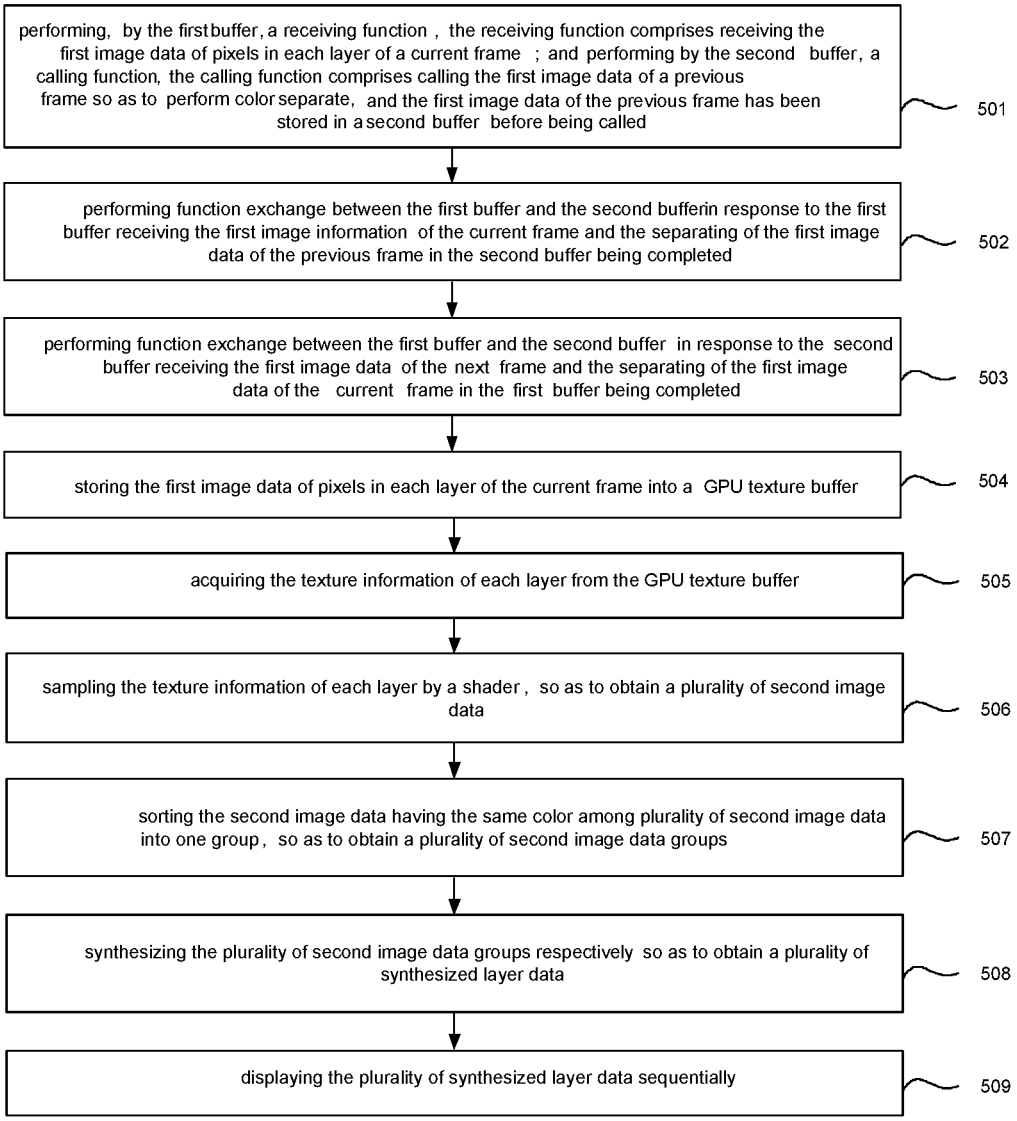
FIG. 5 shows a flow schematic diagram illustrating another display method according to an embodiment of the present disclosure.
Figure 6:
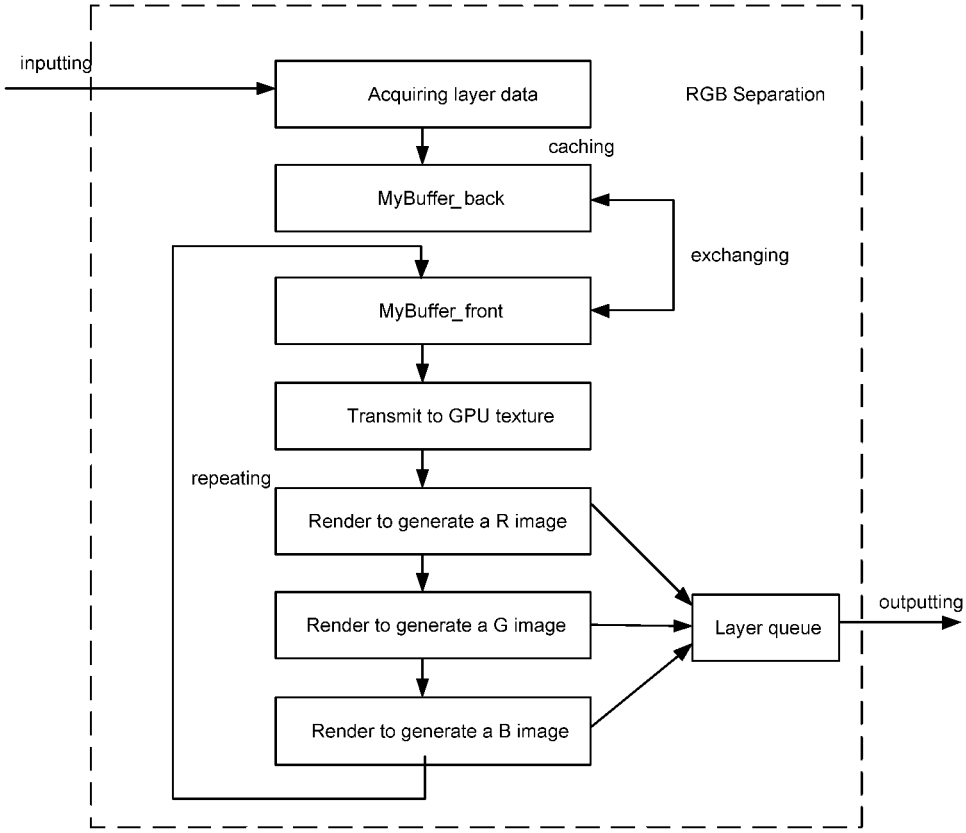
FIG. 6 shows a flow schematic diagram illustrating a method for separating and sorting according to an embodiment of the present disclosure.

Therefore, an embodiment of the present disclosure provides a display method of a display device. The display device may include a first buffer and a second buffer. Referring to FIGS. 5 and 6, the display method may include the following steps.

At step 501, a receiving function is performed by the first buffer. The receiving function may comprise receiving the first image data of pixels in each layer of a current frame. A calling function is performed by the second buffer, and the calling function may comprise calling the first image data of a previous frame so as to separate the first image data of the previous frame based on the plurality of color information, and the first image data of the previous frame has been stored in a corresponding buffer before being called.

For example, the first image data of pixels in each layer of the current frame may be obtained from the surfaceflinger and then cached in the first buffer MyBuffer_back.

In an example, the display method may further comprise: initializing the first buffer and the second buffer, prior to step 501. For example, the first buffer MyBuffer_back and the second buffer MyBuffer_front can be built and initialized to 0.

At step 502, functions of the first buffer and the second buffer are exchanged with each other, in response to the first buffer receiving the first image data of pixels in the each layer of the current frame and the separating of the first image data of the previous frame in the second buffer being completed.

The exchanging means that the first buffer is enabled to perform the calling function and the second buffer is enabled to perform the receiving function.

For example, when the first image data of pixels in the each layer of the current frame is cached in the first buffer and the first image data of the previous frame in the second buffer is separated, the functions of the first buffer MyBuffer_back and the second buffer MyBuffer_front are exchanged, i.e. the first buffer is enabled to perform color separation on the first image data of pixels in each layer of the current frame, and the second buffer is enabled to perform the receiving of the first image data of pixels in the each layer of a next frame.

The function exchange between the first buffer MyBuffer_back and the second buffer MyBuffer_front is to ensure that the rate at which the first image data of pixels in each layer of the next frame is stored in the second buffer MyBuffer_front does not affect the rate at which the first image data of pixels in each layer is separated, sorted, and synthesized in the first buffer MyBuffer_back.

Next, at step 503, when the second buffer receives the first image data of pixels in each layer of the next frame, and the first image data of the current frame in the first buffer is completely separated, the function exchange between the first buffer and the second buffer is repeated.

After the first image data of pixels in each layer of the next frame is stored in the second buffer MyBuffer_front, and the first image data of the current frame is completely separated based on the colors, the function exchanging between the first buffer and the second buffer may be repeated.

At step 504, the first image data for pixels in each layer is stored.

For example, the first image data of pixels in each layer of the current frame may be transferred from the first buffer MyBuffer_back to the GPU texture buffer.

At step 505, texture information of each layer is obtained, for example, from the GPU texture buffer.

The first image data of pixels in each layer is stored in the GPU texture buffer in the form of texture. Thus, the texture information of each layer can be obtained from the GPU texture buffer.

At step 506, the texture information of each layer is sampled by a shader, so as to obtain a plurality of second image data of pixels in each layer.

Specifically, the texture information of each layer may be first rendered, so as to be separated to obtain the second image data of the first color R of each layer RA. Then, a second rendering is performed, so as to obtain the second image data of the second color G of each layer GA. After that, a third rendering is performed, so as to obtain the second image data of the third color B of each layer BA, thereby completing the process of color based separation on each layer of the current frame. After the first image data of pixels in each layer of the next frame is stored in the second buffer MyBuffer_front, the processes of exchanging functions between the first buffer and the second buffer, storing in the GPU texture cache, and obtaining the texture information of each layer from the GPU texture cache and three times rendering process may be repeated.

In the example separation process, Opengles may be used to render the position information and texture information of each layer, extract the RA data in RGBA, and combine the original vertex information to generate a new RA layer cache. It should be noted that the process of G extraction and B extraction is the same as the R extraction. Thus, the source layer becomes a queue of "position information+RA", "position information+GA", and "position information+BA". For example, in an OpenGLes drawing, all graphics are composed of triangles. Therefore, the position information may be vertex information. The position of the triangle can be determined by three vertex coordinates (vertex information).

At step 507, the second image data having the same color information among the plurality of second image i data is sorted into one group, so as to obtain a plurality of second image data groups.

At step 508, the plurality of second image data groups are separately synthesized, so as to obtain a plurality of synthesized layer data.

At step 509, the plurality of synthesized layer data is sequentially displayed in the preset order of the colors.

Steps 507 to 509 in this embodiment are the same as or similar to the steps 103 to 105 in the previous embodiment, and are not described herein again. The description is mainly focused on the differences from the previous embodiment.

The upper UI (designed for the refresh rate of a traditional display) is slow to draw, while the layer RGB separation, sorting, and subsequent layer synthesis are all refreshed at a triple refresh rate under the driving of the VYSNC signal. If there is only one buffer, and the next frame layer drawn by the UI is suddenly transmitted during the separation of the current frame, there is information on the new frame and information on the current frame at the same time. Thus, the separated layer queue will be disordered. Therefore, the first buffer is set to wait for the drawing of the UI, and at the same time, and the second buffer is set to enable reading the layer data therefrom for each layer separation (the operation speed of the GPU layer separation is very fast) under the driving of the VYSNC signal. After all layers are drawn by the upper UI and stored in the first buffer, the functions between the first buffer and the second buffer are exchanged. At this time, the second layer stores the latest layer data. Therefore, a new layer separation can be started, and the first buffer will be overwritten by a new UI drawing.

The display method provided in this embodiment uses a two-buffer (first buffer and second buffer) mechanism to avoid the influence of the slow drawing rate of the upper layer, and ensure that the rate of the upper layer drawing does not affect the rate of the subsequent RGB separation, synthesis and output. The exchanging mechanism between the first buffer and the second buffer enable the field sequential display screen to normally read the frame data in the order of R, G, and B at a rate being three times of a normal screen, so that the traditional UI can be applied to the field sequential display without modification. Moreover, this embodiment utilizes the GPU to perform off-screen rendering on the RGB data of the separated image for times, meanwhile the GPU massive parallel computing ensures the speed of image separation.

According to the display method of the embodiment, the system such as Android or the like may transmit the R/G/B image data obtained by separation to fb0 (LCD device node) at a triple frequency. The field sequence display can be applied to electronic devices such as mobile terminals, reducing the cost reduced by 20-30%. Theoretically, the power consumption is reduced by about 30% with a same brightness and a same resolution, and meanwhile the life time of electronic devices such as mobile phones is improved.

Figure 7:
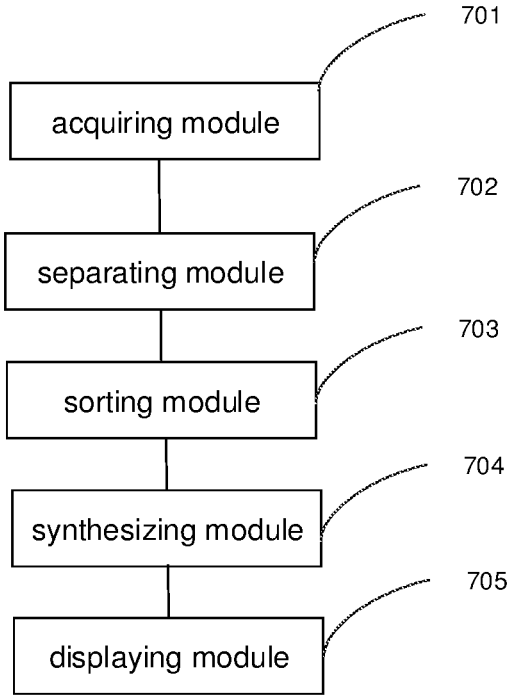
FIG. 7 shows a structural diagram illustrating a display device according to an embodiment of the present disclosure.

FIG. 7 shows a structural diagram illustrating a display device according to an embodiment of the present disclosure. The display device can be applied to an electronic device. With reference to FIG. 7, the display device can include an acquiring module 701, a separating module 702, a sorting module 703, a synthesizing module 704 and a displaying module 705.

The acquiring module 701 may be configured to acquire an image to be displayed, the image comprising a plurality of layers and acquire the first image data of pixels in each of the plurality of layers. For example, the first image data may comprise a plurality of color information and transparency information.

The separating module 702 may be configured to separate the first image data based on the plurality of color information, so as to obtain a plurality of second image data of the pixels in each of the plurality of layers. Each of the plurality of second image data may comprise a color information and a transparency information.

The sorting module 703 may be configured to sort the second image data having the same color information among the plurality of second image data into one group, so as to obtain a plurality of second image data groups.

The synthesizing module 704 may be configured to synthesize the second image data in the plurality of second image data groups respectively, so as to obtain a plurality of synthesized layer data.

The displaying module 705 may be configured to display the plurality of synthesized layer data sequentially in the preset order of the colors.

Figure 8:
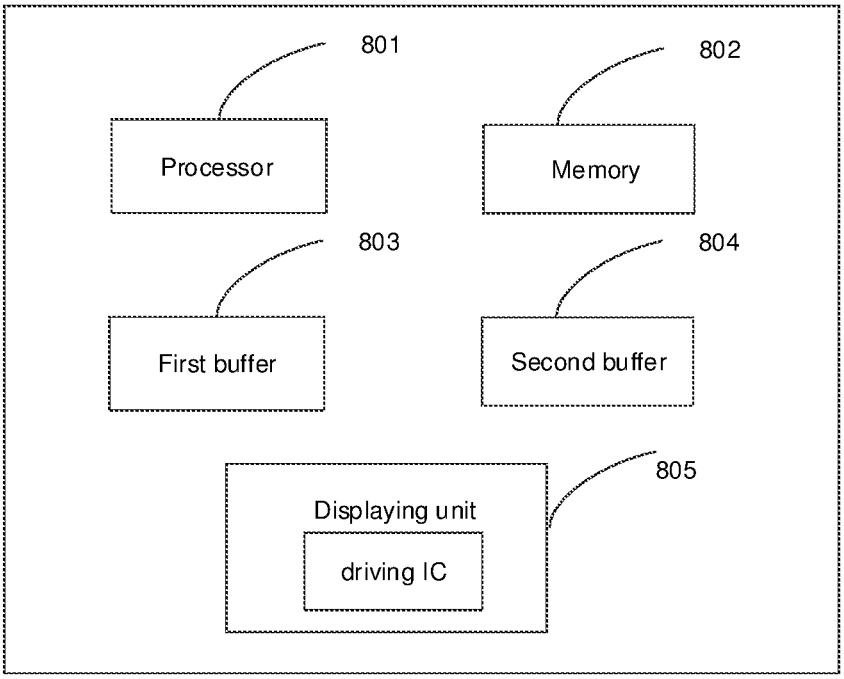
FIG. 8 shows another structural diagram illustrating the display device according to an embodiment of the present disclosure.

FIG. 8 shows another structural diagram illustrating the display device according to an embodiment of the present disclosure. Referring to FIG. 8, a display device may include: one or more processors 801; and a memory 802 configured to store one or more programs. The one or more processors 801 are configured to execute the one or more programs, so as to implement the method in accordance with the above embodiments of the disclosure.

In an implementation, the display device may include a first buffer 803 and a second buffer 804. The one or more processors 801 are further configured to: enable the first buffer to perform a receiving function, and the receiving function may comprise receiving the first image data of pixels in each layer of a current frame; enable the second buffer to perform a calling function, and the calling function may comprises calling the first image data of a previous frame so as to separate the first image data of the previous frame based on the plurality of color information, and the first image data of the previous frame has been stored in a corresponding buffer before being called; and enable the first buffer to perform the calling function and the second buffer to perform the receiving function, in response to the first buffer receiving the first image data of pixels in the each layer of the current frame and the separating of the first image data of the previous frame in the second buffer being completed.

As shown in FIG. 8, the display device may further include a displaying unit 805. The displaying unit 805 further comprises: a driving IC, configured to parse and output the plurality of synthesized layer data sequentially, so as to be displayed by the displaying unit.

With respect to the devices in the above embodiments, the specific manner in which the respective modules operates and the advantageous effects of the respective modules have been described in detail in the embodiments relating to the method, and will not be explained in detail herein.

Another embodiment of the present application further provides an electronic device, including the display device according to any of the above embodiments.

It should be noted that the electronic device in this embodiment may be any product or component having a display function, such as a display panel, an electronic paper, a mobile phone, a tablet computer, a television, a notebook computer, a digital photo frame, a navigator, and the like.

Another embodiment of the present application further provides a computer readable storage medium having computer programs stored thereon which, when executed by a processor, implement the display method in accordance with any of the above embodiments of the present disclosure.

The embodiments of the present disclosure provide a display method, a display device, an electronic device, and a computer readable storage medium, which may comprise: acquiring a first image data of pixels in each of the plurality of layers; separating the first image data based on the plurality of color information, so as to obtain a plurality of second image data of the pixels in each of the plurality of layers; sorting the second image data having the same color information among the plurality of second image data into one group, so as to obtain a plurality of second image data groups; synthesizing the second image data in the plurality of second image data groups respectively, so as to obtain a plurality of synthesized layer data; and displaying portions having the same color among the plurality of synthesized layer data sequentially, thereby performing the field sequential display correctly, reducing the cost and the power consumption, and increasing the battery life. Further, since the field sequence display does not need to set sub-pixels, the aperture ratio can be increased by 33% theoretically, and a higher PPI can be achieved based on the existing process, achieving a better display effect.

Various embodiments in the present description are described in a progressive manner, and each embodiment is described by focusing on the difference from other embodiments, and the same or similar components or steps among the various embodiments can be referred to each other.

Finally, it should also be noted that in this context, relational terms such as "first" and "second" are used merely to distinguish one entity or operation from another entity or operation, and do not necessarily require or imply any relationship or order among these entities or operations. Furthermore, the terms of "comprises" or "comprising" or "include" or any other variations are intended to encompass a non-exclusive inclusion, such that a process, method, product, or device comprising a series of elements is not only intended to include the listed elements, but also to include other elements that are not listed, or elements that are inherent to such a process, method, product, or device. An element defined by the phrase "comprising a . . . " does not mean that there is only one such element comprised, i.e., the process, method, product, or device including the element does not exclude the presence of additional equivalent elements therein, unless otherwise stated.

The display method, the display device, the electronic device and the computer readable storage medium according to the embodiments of the present disclosure are described in detail. The principles and implementations of the embodiments of the present disclosure are described with reference to specific examples. The description of the examples is only for the purpose of facilitating in understanding the method and the idea of the embodiments of the present disclosure. All changes or substitutions that are easily conceived by those skilled in the art in view of the embodiments of the present disclosure are intended to be included within the scope of the present disclosure. Therefore, the description herein should not be considered as a limit to the embodiments of the disclosure.

We claim:

1. A method of displaying by a display device, comprising:

acquiring an image to be displayed, the image comprising a plurality of n layers;

acquiring a first image data of pixels in each of the plurality of layers, wherein the first image data comprises a plurality of color information and transparency information;

separating the first image data based on the plurality of color information, so as to obtain a plurality of second image data of the pixels in each layer of the plurality of layers, wherein each second image data of the plurality of second image data comprises one color information and a transparency information;

sorting the second image data having a same color information among the plurality of second image data into one group, so as to obtain a plurality of second image data groups according to colors;

synthesizing the second image data belonging to one and the same group of the plurality of second image data groups to a synthesized layer data respectively, so as to obtain a plurality of synthesized layer data;

wherein obtaining the plurality of synthesized layer data by synthesizing for each color $C_i$ with i=Red (R), Green (G) and Blue (B) of the colors RGB, is computed as follow:

$C_i$ layer$=X_j=C_{ij}*A_j+X_{j-1}*(1-A_j)$, with $X_j$ is layer $j^{th}$ for color $C_i$, $C_{ij}$ is the color information for $C_i$ at layer $j^{th}$, $A_j$ is the transparent information of $C_i$ at layer $j^{th}$, $X_{j-1}$ is previously computed for layer $j-1^{th}$ for color $C_i$ in same manner to $X_i$, $X_1=C_{i1}$, j=n . . . 2 and n is an integer greater than 2; and displaying the plurality of synthesized layer data sequentially in a first preset order of the colors.

2. The display method of claim 1, wherein the display device comprises a first buffer and a second buffer, and wherein acquiring the first image data of pixels in each of the plurality of layers comprises:

performing, by the first buffer, a receiving function, wherein the receiving function comprises receiving the first image data of pixels in each layer of a current frame;

performing, by the second buffer, a calling function, wherein the calling function comprises calling the first image data of a previous frame so as to separate the first image data of the previous frame based on the plurality of color information, and the first image data of the previous frame has been stored in a corresponding cache before being called; and enabling the first buffer to perform the calling function and the second buffer to perform the receiving function, in response to the first buffer receiving the first image data of pixels in the each layer of the current frame and the separating of the first image data of the previous frame in the second buffer being completed.

3. The display method of claim 2, wherein separating the first image data based on the plurality of color information, so as to obtain the plurality of second image data of the pixels in each of the plurality of layers, comprises:

obtaining texture information of each layer; and sampling the texture information of each layer, so as to obtain the plurality of second image data of the pixels in each layer.

4. The display method of claim 1, wherein synthesizing the second image data comprises:

arranging the plurality of second image data groups in a second preset order, so as to generate a queue; and reading and synthesizing the second image data in the plurality of second image data groups in the queue sequentially, so as to obtain the plurality of synthesized layer data.

5. The display method of claim 1, wherein synthesizing the second image data in the plurality of second image data groups respectively so as to obtain the plurality of synthesized layer data comprises:

synthesizing the second image data in each of the plurality of second image data groups respectively by using a Mobile Display Processor (MDP) or a Graphics Processing Unit (GPU), so as to obtain the plurality of synthesized layer data.

6. The display method of claim 1, wherein displaying the plurality of synthesized layer data sequentially comprises:

parsing and outputting the plurality of synthesized layer data sequentially in the first preset order of the colors for displaying.

7. A display device, comprising:

one or more processors; and a memory, configured to store one or more programs, wherein the one or more processors are configured to execute the one or more programs, so as to implement the method of claim 1.

8. The display device of claim 7, further comprising a first buffer and a second buffer, wherein the one or more processors are further configured to:

enable the first buffer to perform a receiving function, wherein the receiving function comprises receiving the first image data of pixels in each layer of a current frame;

enable the second buffer to perform a calling function, wherein the calling function comprises calling the first image data of a previous frame so as to separate the first image data of the previous frame based on the plurality of color information, and the first image data of the previous frame has been stored in a corresponding cache before being called; and enable the first buffer to perform the calling function and the second buffer to perform the receiving function, in response to the first buffer receiving the first image data of pixels in the each layer of the current frame and the separating of the first image data of the previous frame in the second buffer being completed.

9. The display device of claim 7, wherein the one or more processors are further configured to:

obtain texture information of each layer; and sample the texture information of each layer, so as to obtain the plurality of second image data of the pixels in each layer.

10. The display device of claim 7, wherein the one or more processors are further configured to:

arrange the plurality of second image data groups in a second preset order, so as to generate a queue; and read and synthesize the second image data in the plurality of second image data groups in the queue sequentially, so as to obtain the plurality of synthesized layer data.

11. The display device of claim 7, wherein the one or more processors are further configured to:

synthesize the second image data in the plurality of second image data groups respectively by using a Mobile Display Processor (MDP) or a Graphics Processing Unit (GPU), so as to obtain a plurality of synthesized layer data.

12. The display device of claim 7, further comprising:

a driving IC, configured to parse and output the plurality of synthesized layer data sequentially in the first preset order of the colors, so as to be displayed byte display device.

13. An electronic device comprising the display device of claim 7.

14. A non-transitory computer readable storage medium having computer programs stored thereon which, when executed by a processor, implement the method of claim 1.

* * * * *